US006997798B2

(12) United States Patent
Jensen

(10) Patent No.: US 6,997,798 B2
(45) Date of Patent: Feb. 14, 2006

(54) CHIMNEY CAP

(75) Inventor: Guy Jensen, Venice, FL (US)

(73) Assignee: Chimney Kap Products, Winchester, KY (US)

( * ) Notice: Subject to any disclaimer, the term of this patent is extended or adjusted under 35 U.S.C. 154(b) by 0 days.

(21) Appl. No.: 10/793,297

(22) Filed: Mar. 4, 2004

(65) Prior Publication Data

US 2005/0197055 A1 Sep. 8, 2005

(51) Int. Cl.
*F23J 13/08* (2006.01)

(52) U.S. Cl. ..... 454/4; 52/198

(58) Field of Classification Search ..... 454/4, 454/12, 35, 36, 37, 38; 52/198, 199
See application file for complete search history.

(56) References Cited

U.S. PATENT DOCUMENTS

| | | | | | |
|---|---|---|---|---|---|
| 678,083 | A | * | 7/1901 | Witte | 454/12 |
| 850,126 | A | * | 4/1907 | Bayley | 454/12 |
| 2,423,672 | A | | 7/1947 | Zucker | |
| 2,766,678 | A | * | 10/1956 | Morris | 454/12 |
| 2,976,796 | A | | 3/1961 | Anthony | |
| 3,650,198 | A | * | 3/1972 | Stone | 454/37 |
| 4,142,457 | A | * | 3/1979 | Zaniewski | 454/38 |
| 4,202,255 | A | | 5/1980 | McNamara | |
| 4,334,460 | A | * | 6/1982 | Simmons et al. | 454/4 |
| 4,436,021 | A | * | 3/1984 | Hisey | 454/12 |
| 4,549,473 | A | | 10/1985 | Alexander | |
| 4,732,078 | A | * | 3/1988 | Giumenta et al. | 454/3 |
| 4,920,867 | A | * | 5/1990 | Joly | 454/3 |
| 5,402,613 | A | * | 4/1995 | Giumenta et al. | 52/244 |
| 5,842,918 | A | * | 12/1998 | Cowen | 454/12 |
| 6,022,269 | A | * | 2/2000 | Arbucci | 454/12 |
| 6,152,817 | A | * | 11/2000 | Daniels et al. | 454/12 |

OTHER PUBLICATIONS

Copperfield Chimney Supply, Inc., Catalog Sep. 23, 2002, pp. 26-34.

* cited by examiner

*Primary Examiner*—Derek S. Boles
(74) *Attorney, Agent, or Firm*—Andrew W. Ludy

(57) ABSTRACT

A plastic chimney cap is molded in one-piece from either a thermoset or a thermoplastic resin. The chimney cap has a wall extending continuously around a closed-circuit. The wall interior surface defines an interior space. A plurality of vent holes through the wall communicates with the interior space to vent combustion gases. A roof is attached to the upper edge of the wall. A flange is disposed outside the lower edge of the wall and has a perimeter extending completely around the wall. A shoulder connects the flange with the wall. Thickened reinforced regions with threaded holes and mounting screws are spaced apart around the flange perimeter for fastening the chimney cap to the flue. The interior surfaces can be coated with a metallized coating for heat resistance.

17 Claims, 3 Drawing Sheets

CHIMNEY CAP

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to the field of chimney caps, and more particularly to a one-piece, molded plastic chimney cap.

Chimney caps are known in the art, and have taken a variety of configurations in the past. Typically, they are made of a number of parts fastened together with rivets or screws. This construction has drawbacks in that the several parts must be stamped or otherwise formed, each piece with separate tooling. Then the pieces are assembled together with fasteners, which is a labor-intensive process. The parts are typically stainless steel, galvanized steel, or copper. The galvanized steel and copper parts are subject to eventual corrosion and failure. Fasteners can also corrode, causing the cap to fall apart. The vented side walls of the cap are typically wire screen. The screen can be damaged or loosened by corrosion or by wind-blown debris, thereby admitting vermin or birds into the house.

Accordingly, there is a need to provide a chimney cap that is made of a one-piece construction, thereby eliminating fasteners and assembly.

There is a further need to provide a chimney cap of the type described and that is not subject to rust, corrosion, or deterioration.

There is a yet further need to provide a chimney cap of the type described and that cannot admit vermin or birds into the house.

There is a still further need to provide a chimney cap of the type described and that is of rugged construction for long service life.

There is another need to provide a chimney cap of the type described and that can be manufactured cost-effectively in large numbers of high quality.

BRIEF SUMMARY OF THE INVENTION

In accordance with the present invention, there is provided a chimney cap for use in connection with a chimney flue. The flue has an outside surface and a top edge. The flue exhausts combustion gases from a furnace inside a building. The chimney cap comprises at least one wall. The wall extends between opposite upper and lower edges, and it extends continuously around a closed circuit. The wall has opposite exterior and interior surfaces, with the interior surface defining an interior space. The wall also has a plurality of vent holes through it, which communicate with the interior space to vent the combustion gases.

A roof is attached to the upper edge of the wall. The roof has opposite exterior and interior surfaces. A flange is located adjacent the lower edge of the wall and spaced outside the wall a predetermined distance. The flange has a perimeter extending completely around the wall, and a predetermined thickness. The flange has an interior surface for overlapping engagement with the flue outside surface. A shoulder connects the flange with the lower edge of the wall. The shoulder extends completely around the wall. The shoulder has an interior surface that rests upon the flue top edge. The wall, roof, flange, and shoulder are of one-piece construction. Fastening means are provided for fastening the chimney cap to the flue.

The wall, roof, flange, and shoulder of the chimney cap are molded from a polymeric resin selected from the group consisting of thermoset resins and thermoplastic resins.

BRIEF DESCRIPTION OF THE SEVERAL VIEWS OF THE DRAWING

A more complete understanding of the present invention may be obtained from consideration of the following description in conjunction with the drawing, in which.

DETAILED DESCRIPTION OF THE INVENTION

Figure 1:
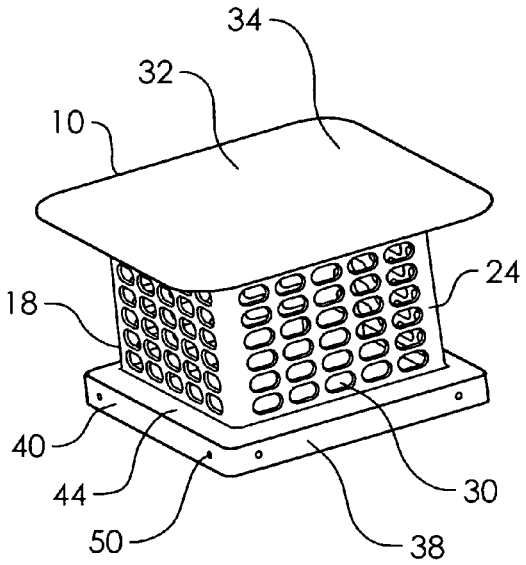
FIG. 1 is a perspective view of a chimney cap constructed in accordance with the invention.

Referring now to the drawing, and especially to FIGS. 1, 2, 3, 4, and 5 thereof, a chimney cap constructed in accordance with the invention is shown at 10, and is for use in connection with a chimney 11 and chimney flue 12. The flue 12 has an outside surface 14 and a top edge 16, and is used for exhausting combustion gases from a furnace inside a building (not shown). The chimney cap 10 comprises at least one wall 18, which extends between opposite upper 20 and lower 22 edges. The wall 18 extends continuously around a closed circuit. The circuit typically is generally rectangular with radiused corners, but alternatively can be any shape, such as generally circular. The wall 18 has opposite exterior 24 and interior 26 surfaces, with the interior surface 26 defining an interior space 28. The wall 18 has a plurality of vent holes 30 through it that communicate with the interior space 28 to vent the combustion gases. A roof 32 is attached to the upper edge 20 of the wall 18. The roof 32 has opposite exterior 34 and interior 36 surfaces.

A flange 38 is located adjacent the lower edge 22 of the wall 18 and is spaced outside the wall 18 a predetermined distance D. That distance is sufficient to support the chimney cap 10 upon the flue top edge 16, and ranges from about 0.5 inch (13 mm) to about 2 inches (50 mm). The flange 38 has a perimeter 40 extending completely around the wall 18. The flange 38 has a predetermined thickness T1. The flange 38 has an interior surface 42 for overlapping engagement with the flue outside surface 14.

A shoulder 44 connects the flange 38 with the lower edge 22 of the wall 18, and extends completely around the wall 18. The shoulder 44 has an interior surface 46 for resting upon the flue top edge 16. The wall 18, roof 32, flange 38, and shoulder 44 are of one-piece construction with a thickness typically ranging from about 0.12 inch (3 mm) to 0.37 inch (9 mm). The wall 18, roof 32, flange 38, and shoulder 44 are molded from a polymeric resin which can be either a thermoset resin or a thermoplastic resin. The wall interior surface 26 and the roof interior surface 36 can be coated with a metallized coating for heat resistance.

Figure 2:
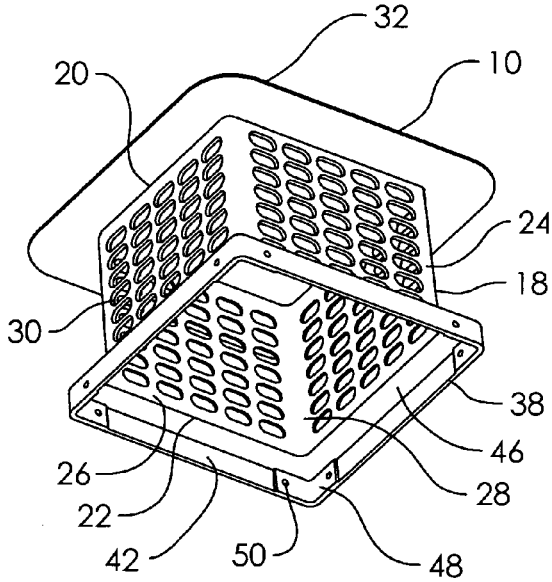
FIG. 2 is another perspective view of the chimney cap of FIG. 1.
Figure 3:
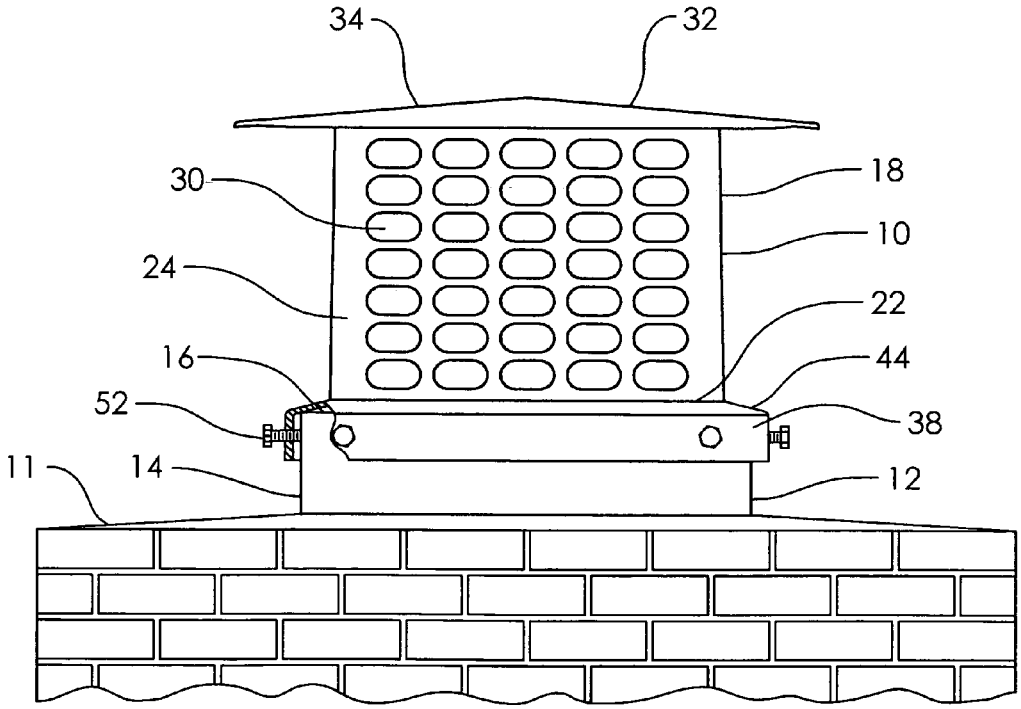
FIG. 3 is a front elevational view of the chimney cap of FIG. 1, showing the chimney cap assembled onto a chimney flue.
Figure 4:
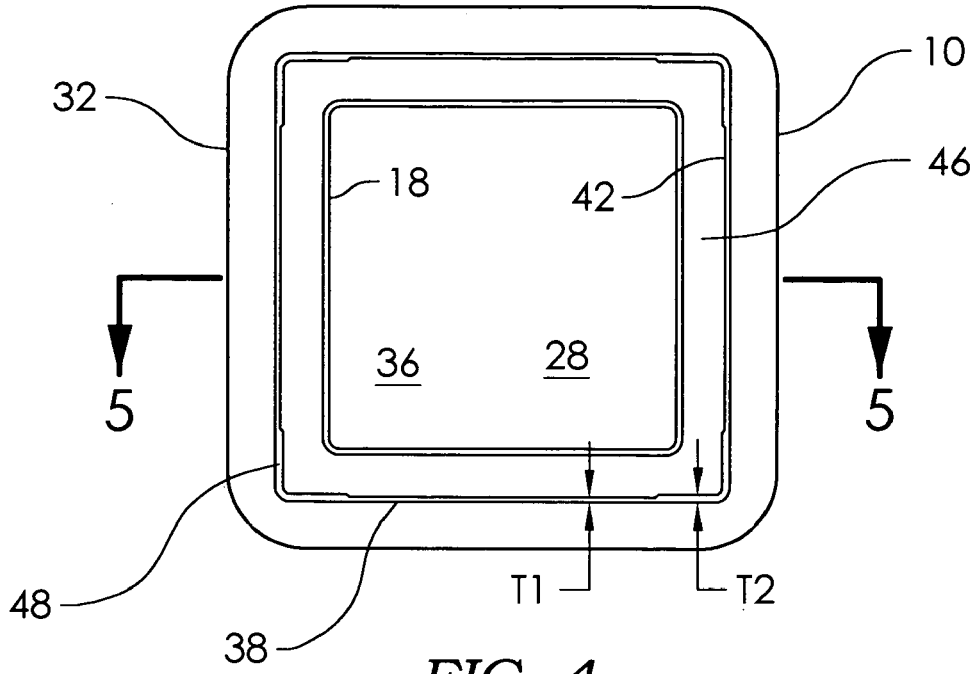
FIG. 4 is a bottom plan view of the chimney cap of FIG. 1.
Figure 5:
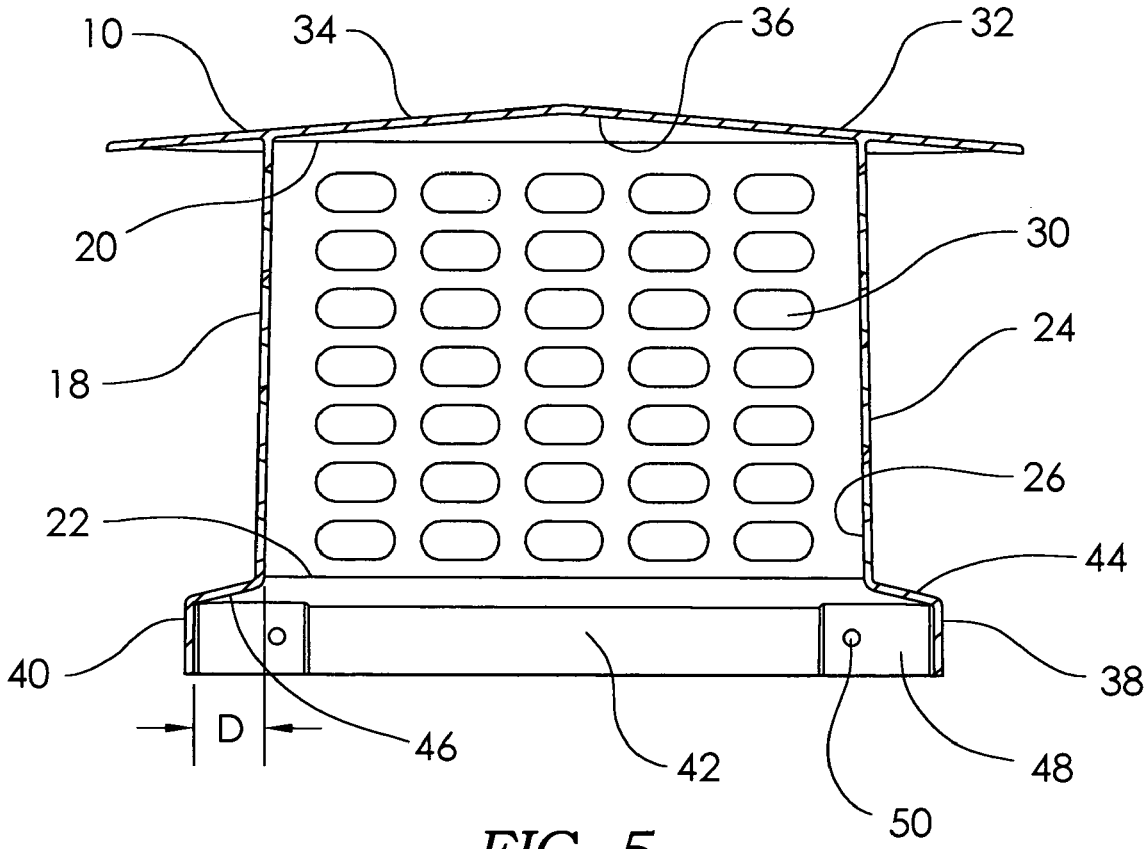
FIG. 5 is a cross-sectional elevational view of the chimney cap of FIG. 1, taken along lines 5—5 of FIG. 4.
Figure 6:
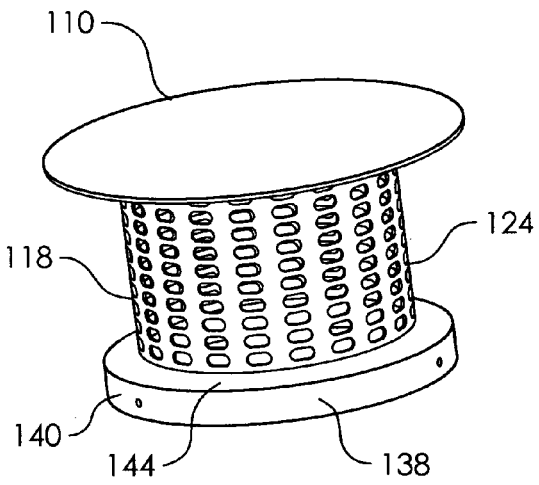
FIG. 6 is a perspective view of another chimney cap constructed in accordance with the invention.
Figure 7:
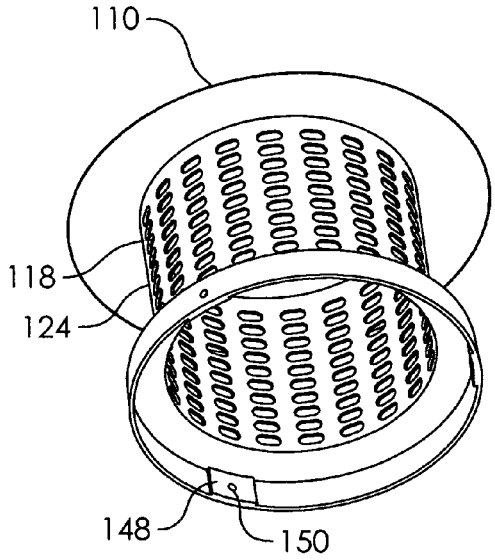
FIG. 7 is another perspective view of the chimney cap of FIG. 6.
Figure 8:
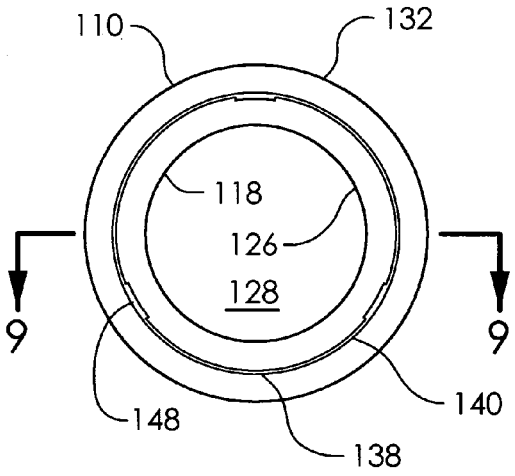
FIG. 8 is a bottom plan view of the chimney cap of FIG. 6.
Figure 9:
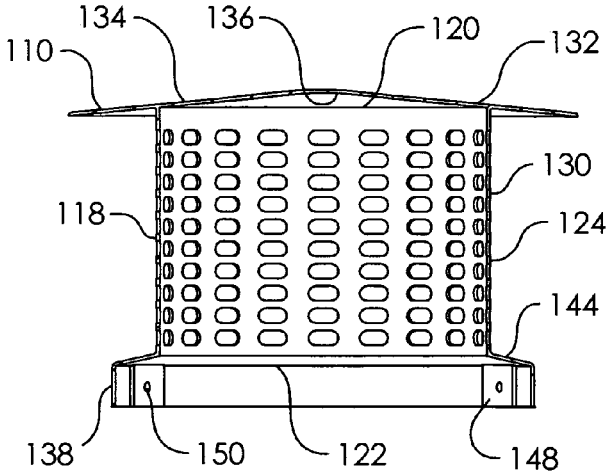
FIG. 9 is a cross-sectional elevational view of the chimney cap of FIG. 6, taken along lines 9—9 of FIG. 8.

Fastening means are provided for fastening the chimney cap 10 to the flue 12. Specifically, the fastening means comprises a plurality of reinforced regions 48 integral with the flange 38. The reinforced regions 48 are spaced apart around the flange perimeter. Each reinforced region 48 has a thickness T2 greater than the flange predetermined thickness T1. Each reinforced region 48 has at least one threaded hole 50 through it. In the case of a rectangular wall circuit, the reinforced regions 48 are located at each corner, as shown in FIGS. 2 and 4. A plurality of screws 52 are provided, each screw 52 engaging one of the threaded holes 50. To assemble the chimney cap 10 onto the flue 12, the chimney cap 10 is placed over the flue 12 so that the flange 38 overlaps the flue 12. The shoulder interior surface 46 is brought to rest upon the flue top edge 16, and the screws 52 are tightened.

Turning now to FIGS. 6, 7, 8, and 9, another chimney cap constructed in accordance with the invention is shown at 110. Chimney cap 110 differs from the above-described invention in that the wall 118, which extends between opposite upper 120 and lower 122 edges, extends continuously around a closed circuit which is generally circular. Chimney cap 110 is similar to the above-described invention in that the wall 118 has opposite exterior 124 and interior 126 surfaces, with the interior surface 126 defining an interior space 128. The wall 118 has a plurality of vent holes 130 through it that communicate with the interior space 128 to vent the combustion gases. A roof 132 is attached to the upper edge 120 of the wall 118. The roof 132 has opposite exterior 134 and interior 136 surfaces.

A flange 138 is located adjacent the lower edge 122 of the wall 118 and is spaced outside the wall 118 a predetermined distance. The flange 138 has a perimeter 140 extending completely around the wall 118. Reinforced regions 148 are spaced apart around the flange perimeter. Each reinforced region 148 has at least one threaded hole 150 through it. The flange 138 has a predetermined thickness.

A shoulder 144 connects the flange 138 with the lower edge 122 of the wall 118, and extends completely around the wall 118. The wall 118, roof 132, flange 138, and shoulder 144 are of one-piece construction. Fastening means are provided for fastening the chimney cap 110 to the flue 12.

A capping method is also disclosed for capping a chimney flue 12. The method comprises the steps of extending at least one wall 18 of a chimney cap 10 between opposite upper 20 and lower 22 edges, extending the wall continuously around a closed circuit, and extending the wall 18 between opposite exterior 24 and interior 26 surfaces, then defining an interior space 28 with the interior surface 26. Next, penetrating the wall 18 with a plurality of vent holes 30, and communicating the vent holes 30 with the interior space 28. Next, attaching a roof 32 to the upper edge 20 of the wall 18, and extending the roof 32 between opposite exterior 34 and interior 36 surfaces. Next, providing a flange 38 adjacent the lower edge 22 of the wall 18, spacing the flange 38 outside the wall 18 a predetermined distance D, and extending the flange 38 completely around the wall 18, then connecting the flange 38 and the lower edge 22 of the wall 18 with a shoulder 44, and extending the shoulder 44 completely around the wall 18. Next, constructing the wall 18, roof 32, flange 38, and shoulder 44 of one-piece. Next, overlapping the flue outside surface 14 with an interior surface 42 of the flange 38, resting an interior surface 46 of the shoulder 44 upon the flue top edge 16, and fastening the chimney cap 10 to the flue 12, then venting the combustion gases through the vent holes 30.

Another step comprises molding the wall 18, roof 32, flange 38, and shoulder 44 from a polymeric resin selected from the group consisting of thermoset resins and thermoplastic resins.

Yet another step comprises applying a metallized coating to the wall interior surface 26 and the roof interior surface 36 for heat resistance.

Further steps comprise forming a plurality of reinforced regions 48 integral with the flange 38, providing each reinforced region 48 with a thickness T2 greater than a flange predetermined thickness T1, then spacing the reinforced regions 48 apart around a flange perimeter 40. Next, forming at least one threaded hole 50 through each reinforced region 48, and engaging each one of the threaded holes 50 with a screw 52, then tightening the screws 52, thereby fastening the chimney cap 10 to the flue 12.

A yet further step includes extending the wall 18 continuously around a rectangular closed circuit. An alternative step includes extending the wall 18 continuously around a circular closed circuit.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

The invention claimed:

1. A chimney cap for use in connection with a chimney flue, the flue having an outside surface and a top edge, the flue exhausting combustion gases, the chimney cap comprising:

(a) at least one wall, the wall extending between opposite upper and lower edges, the wall extending continuously around a closed circuit, the wall having opposite exterior and interior surfaces, the interior surface defining an interior space, the wall having a plurality of vent holes therethrough, the vent holes communicating with the interior space to vent the combustion gases;

(b) a roof integral with the upper edge of the wall, the roof having opposite exterior and interior surfaces;

(c) a flange adjacent the lower edge of the wall and spaced outside the wall a predetermined distance, the flange having a perimeter extending completely and continuously around the wall, the flange having a predetermined thickness, the flange having an interior surface for overlapping engagement with the flue outside surface;

(d) a shoulder connecting the flange with the lower edge of the wall, the shoulder extending completely and continuously around the wall, the shoulder having an interior surface for resting upon the flue top edge, the wall, roof, flange, and shoulder being of one-piece construction; and (e) fastening means for fastening the chimney cap to the flue.

2. The chimney cap of claim 1, wherein the wall, roof, flange, and shoulder are molded from a polymeric resin selected from the group consisting of thermoset resins and thermoplastic resins.

3. The chimney cap of claim 2, wherein the wall interior surface and the roof interior surface further comprise a metallized coating for heat resistance.

4. The chimney cap of claim 2, wherein the fastening means further comprises:

(a) a plurality of reinforced regions integral with the flange, each reinforced region extending a predetermined distance along the flange perimeter, the reinforced regions being spaced apart around the flange perimeter, and a plurality of intermediate regions, each intermediate region being disposed between two adjacent reinforced regions, each intermediate region extending along the perimeter for a distance greater than the predetermined distance each reinforced region having a thickness greater than the flange predetermined thickness, each intermediate region having a thickness equal to the flange predetermined thickness, each reinforced region having at least one threaded hole therethrough; and (b) a plurality of screws, each screw engaging one of the threaded holes, so that upon assembling the chimney cap onto the flue, the flange will overlap the flue, the shoulder interior surface will rest upon the flue top edge, and the screws will be tightened, thereby fastening the chimney cap to the flue.

5. The chimney cap of claim 4, wherein the wall extends continuously around a generally rectangular closed circuit.

6. The chimney cap of claim 4, wherein the wall extends continuously around a generally circular closed circuit.

7. A chimney cap for use in connection with a chimney flue, the flue having an outside surface and a top edge, the flue exhausting combustion gases, the chimney cap comprising:

(a) at least one wall, the wall extending between opposite upper and lower edges, the wall extending continuously around a closed circuit, the wall having opposite exterior and interior surfaces, the interior surface defining an interior space, the wall having a plurality of vent holes therethrough, the vent holes communicating with the interior space to vent the combustion gases;

(b) a roof integral with the upper edge of the wall, the roof having opposite exterior and interior surfaces;

(c) a flange adjacent the lower edge of the wall and spaced outside the wall a predetermined distance, the flange having a perimeter extending completely and continuously around the wall, the flange having a predetermined thickness, the flange having an interior surface for overlapping engagement with the flue outside surface, the flange having a plurality of integral reinforced regions, each reinforced region extending a predetermined distance along the flange Perimeter the reinforced regions being spaced apart around the flange perimeter, and a plurality of intermediate regions, each intermediate region being disposed between two adjacent reinforced regions each intermediate region extending along the perimeter for a distance greater than the predetermined distance, each reinforced region having a thickness greater than the flange predetermined thickness, each intermediate region having a thickness equal to the flange predetermined thickness each reinforced region having at least one threaded hole therethrough; and (d) a shoulder connecting the flange with the lower edge of the wall, the shoulder extending completely and continuously around the wall, the shoulder having an interior surface for resting upon the flue top edge, the wall, roof, flange, and shoulder being molded in one-piece from a polymeric resin.

8. The chimney cap of claim 7, wherein the polymeric resin is selected from the group consisting of thermoset resins and thermoplastic resins.

9. The chimney cap of claim 8, further comprising a plurality of screws, each screw engaging one of the threaded holes, so that upon assembling the chimney cap onto the flue, the flange will overlap the flue, the shoulder interior surface will rest upon the flue top edge, and the screws will be tightened, thereby fastening the chimney cap to the flue.

10. The chimney cap of claim 9, further comprising a metallized coating on the wall interior surface and the roof interior surface for heat resistance.

11. A chimney cap for use in connection with a chimney flue, the flue having an outside surface and a top edge, the flue exhausting combustion gases, the chimney cap comprising:

(a) at least one wall, the wall extending between opposite upper and lower edges, the wall extending continuously around a closed circuit, the wall having opposite exterior and interior surfaces, the interior surface defining an interior space, the wall having a plurality of vent holes therethrough, the vent holes communicating with the interior space to vent the combustion gases;

(b) a roof integral with the upper edge of the wall, the roof having opposite exterior and interior surfaces;

(c) a flange adjacent the lower edge of the wall and spaced outside the wall a predetermined distance, the flange having a perimeter extending completely and continuously around the wall, the flange having a predetermined thickness, the flange having an interior surface for overlapping engagement with the flue outside surface, the flange having a plurality of integral reinforced regions, each reinforced region extending a predetermined distance along the flange perimeter the reinforced regions being spaced apart around the flange perimeter, and a plurality of intermediate regions, each intermediate region being disposed between two adjacent reinforced regions each intermediate region extending along the perimeter for a distance greater than the predetermined distance each reinforced region having a thickness greater than the flange predetermined thickness, each intermediate region having a thickness equal to the flange predetermined thickness each reinforced region having at least one threaded hole therethrough;

(d) a shoulder connecting the flange with the lower edge of the wall, the shoulder extending completely and continuously around the wall, the shoulder having an interior surface for resting upon the flue top edge;

(e) the wall, roof, flange, and shoulder being molded in one-piece from a polymeric resin selected from the group consisting of thermoset resins and thermoplastic resins;

(f) a metallized coating on the wall interior surface and the roof interior surface for heat resistance; and (g) a plurality of screws, each screw engaging one of the threaded holes, so that upon assembling the chimney cap onto the flue, the flange will overlap the flue, the shoulder interior surface will rest upon the flue top edge, and the screws will be tightened, thereby fastening the chimney cap to the flue.

12. A method of capping a chimney flue, the flue having an outside surface and a top edge, the flue exhausting combustion gases, the method comprising the steps of:

(a) extending at least one wall of a chimney cap between opposite upper and lower edges;

(b) extending the wall continuously around a closed circuit;

(c) extending the wall between opposite exterior and interior surfaces, and defining an interior space with the interior surface;

(d) penetrating the wall with a plurality of vent holes, and communicating the vent holes with the interior space;

(e) attaching a roof integral with the upper edge of the wall, and extending the roof between opposite exterior and interior surfaces;

(f) providing a flange adjacent the lower edge of the wall, spacing the flange outside the wall a predetermined distance, and extending the flange completely around the wall;

(g) connecting the flange and the lower edge of the wall with a shoulder, and extending the shoulder completely and continuously around the wall;

(h) constructing the wall, roof, flange, and shoulder of one-piece;

(i) overlapping the flue outside surface with an interior surface of the flange;

(j) resting an interior surface of the shoulder upon the flue top edge;

(k) fastening the chimney cap to the flue; and (l) venting the combustion gases through the vent holes.

13. The method of claim 12, further comprising the step of molding the wall, roof, flange, and shoulder from a polymeric resin selected from the group consisting of thermoset resins and thermoplastic resins.

14. The method of claim 13, further comprising the step of applying a metallized coating to the wall interior surface and the roof interior surface for heat resistance.

15. The method of claim 13, further comprising the steps of:

(a) forming a plurality of reinforced regions integral with the flange;

(b) providing each reinforced region with a thickness greater than a flange predetermined thickness;

(c) spacing the reinforced regions apart around a flange perimeter;

(d) extending each reinforced region a predetermined distance along the flange perimeter;

(e) disposing an intermediate region between each two adjacent reinforced regions:

(f) extending each intermediate region along the perimeter for a distance greater than the predetermined distance;

(g) providing each intermediate region with a thickness equal to the flange predetermined thickness;

(h) forming at least one threaded hole through each reinforced region;

(i) engaging each one of the threaded holes with a screw; and (j) tightening the screws, thereby fastening the chimney cap to the flue.

16. The method of claim 15, further comprising the step of extending the wall continuously around a rectangular closed circuit.

17. The method of claim 15, further comprising the step of extending the wall continuously around a circular closed circuit.

* * * * *